US005108333A

United States Patent [19]

Heider et al.

[11] Patent Number: 5,108,333

[45] Date of Patent: Apr. 28, 1992

[54] METHOD OF MAKING A DOUBLE-ENDED HIGH-PRESSURE DISCHARGE LAMP

[75] Inventors: Jürgen Heider, Munich; Dieter Lang, Holzkirchen; Hartmuth L. Bastian, Munich; Stefan Kotter, Munich; Richard Kotschenreuther, Munich, all of Fed. Rep. of Germany

[73] Assignee: Patent Treuhand für elektrische Glühlampen m.b.H., Munich, Fed. Rep. of Germany

[21] Appl. No.: 452,221

[22] Filed: Dec. 15, 1989

[30] Foreign Application Priority Data

Dec. 19, 1988 [DE] Fed. Rep. of Germany ..... 3842769
Dec. 19, 1988 [DE] Fed. Rep. of Germany ..... 3842770
Dec. 19, 1988 [DE] Fed. Rep. of Germany ..... 3842772

[51] Int. Cl.[5] ..... H01J 9/32; H01J 9/24

[52] U.S. Cl. ..... 445/26; 445/22; 445/39; 445/40; 445/43; 65/59.26; 65/109; 65/110

[58] Field of Search ..... 445/26, 27, 22, 32, 445/40, 43, 39, 42; 65/105, 109, 34, 42, 59.26, 110

[56] References Cited

U.S. PATENT DOCUMENTS 3,230,028 1/1966 Kayatt ..... 445/26
3,263,852 8/1966 Fridrich ..... 445/26
3,305,289 2/1967 Fridrich ..... 445/26 X
3,685,880 8/1972 Sobieski ..... 445/26
3,689,799 9/1972 Senft .
4,389,201 6/1983 Hansler ..... 445/26
4,414,460 11/1983 Sudo et al. .
4,509,928 4/1985 Morris ..... 445/27
4,797,620 1/1989 Williams .
4,799,912 1/1989 Salgo ..... 445/26
4,975,620 12/1990 Masui et al. .

FOREIGN PATENT DOCUMENTS 0204061 12/1986 European Pat. Off. .

*Primary Examiner*—Kenneth J. Ramsey
*Attorney, Agent, or Firm*—Frishauf, Holtz, Goodman & Woodward

[57] ABSTRACT

To make a small high-pressure discharge lamp, for example of 50 W rating or less, and suitable, for example, for automotive applications, a quartz glass tube is heated, formed with constrictions, and a gas passed therebetween to expand the portion of the tube between the constrictions into olive shape to form the discharge vessel (6). A preformed first electrode system is introduced through one of the constrictions. The electrode system preferably has a zig-zag lead (9) slightly larger than the internal diameter of the tube to provide for self-centering. The tube is then isolated from atmosphere, for example by being placed in a glove box or coupled to a pumping head (15), for introduction therein of a fill substance, for example in pellet form, of a metal halide and, if desired, mercury; and a fill gas, such as argon or, preferably, xenon, preferably after cleaning and flushing the tube. A second electrode system is then introduced, for example within the glove box, and the end of the tube sealed off, with the fill substance therein. A second pinch seal (18) can then be formed externally of the glove box, or while the tube is still connected to a pumping head, and excess end pieces of the tube and the electrodes are cut off.

35 Claims, 7 Drawing Sheets

13
14
15
1
5
6
12
9
1

6a
25
PUMP HEAD
Xe
9
8
7
10
1a
1
5
15
14
6
12
13
9
1

METHOD OF MAKING A DOUBLE-ENDED HIGH-PRESSURE DISCHARGE LAMP

Reference to related application, assigned to the assignee of the present invention, the disclosure of which is hereby incorporated by reference: U.S. Ser. No. 07/452,125, filed Dec. 15, 1989, Arlt et al.

Reference to related publication assigned to the assignee of the present invention: German Utility Model DE GM 86 23 908.

The present invention relates to a method to make a double-ended high-pressure low-power discharge lamp of the type which includes a metal halide fill, and more particularly to such a lamp which has less than 50 watt, for example 35 watt or less nominal power rating, and is suitable for use in headlights of automotive vehicles.

BACKGROUND

Metal halide high-pressure discharge lamps of low power, for example about 50 W or less, have been proposed for use in automotive vehicles. Such lamps are operated at, for example, about 100 V, at frequencies for example about 45 kHz. The operating power is derived from an inverter circuit which, in turn, is energized from an automotive vehicle battery. The referenced application Ser. No. 07/452,125, filed Dec. 15, 1989, assigned to the assignee of the present application, describes such a lamp-circuit combination.

Lamps of the type suitable for use in automotive vehicles previously have been made by first closing an open quartz tube. The generally olive-shaped bulb of the discharge vessel was then formed. The originally closed end was then opened, and an exhaust tube was secured to the discharge vessel approximately at the center thereof. Electrode systems were introduced into the open ends, melted and sealed therein, for example by standard press or pinch seals. Then fills and a fill gas were introduced through the exhaust tube into the discharge vessel, and the exhaust tube was then tipped off. This method is complex, utilizes a number of steps which are difficult to automate, and has the substantial disadvantage that the discharge vessel, which is already tiny, may be subject to non-homogeneities in the material distribution. A typical dimension of the discharge vessel is a length of about 7.5 mm, a diameter of only about 5.5 mm. Attaching, and later on tipping off the exhaust tube may change the distribution of the material so that cold spot temperatures may arise at undesired points during operation of the lamp. Such uncontrolled location and temperature of cold spots can change the color temperature of the emitted light uncontrollably and detrimentally. Further, the light derived from the lamp is difficult to control, so that stray and spread radiation may result. When such lamps are then combined with optical systems such as reflectors, lenses and the like, the light distribution may not be as desired and in accordance with automotive and governmental standards.

THE INVENTION

It is an object to provide a manufacturing method for small high-pressure metal halide discharge lamps, for example of about 50 W or less, in which the discharge vessel will be homogeneous throughout, and the above-described disadvantages are avoided. Additionally, the method should be such that it can be carried out essentially only by automatic machinery.

Briefly, in accordance with the invention, a cylindrical hollow tube, open at both ends, of quartz glass, is heated and circumferentially constricted, for example by rolling. The bulb-like discharge vessel will be formed between the constrictions which, initially, are open. The tube, in other words, is only pinched but not closed. The electrode systems used with the lamp have an external lead, a molybdenum foil, an internal lead or shaft and an electrode tip, for example in essentially spherical or ball shape, at the end of the internal lead. A first such preformed electrode system is introduced into the tube, and aligned so that the electrode tip will be placed at a predetermined position in the tube. The tube is then heated in the region of the location of the sealing foil of the first electrode system and pinch-sealed to form a first pinch seal. Non-gaseous fill substances, for example in pellet form, are then introduced into the region of the tube which will form the discharge vessel through the other, still open end. A second preformed electrode system is introduced through the second still open end of the tube, and aligned therein. The fill gas is introduced through the open end of the tube, which can be done either by stopping-up the open end of the tube and introducing a fill gas, preferably after having flushed and purged the tube; or, the tube together with the electrode system are placed into a glove box and the fill gas and the electrode system are introduced into a tube while both are in the glove box. The now preassembled tube, with the two electrode systems and the fill gas therein, is heated in the region of the location of the sealing foil of the second electrode system, and pinch-sealed in the region of the second foil.

The method has the advantage that no additional exhaust tube must be used, so that the discharge vessel will have the shape determined by the original tube or cane into which the electrode systems are introduced. The tube or cane can be slightly bulged or olive-shaped by expanding it, when heated, after the constrictions have been formed in which, preferably, one constriction is smaller than the other, so that the tube will bulge under applied gas pressure.

The steps of filling and closing the discharge vessel are, in accordance with a feature of the invention, carried out in the high purity atmosphere of a glove box. Thus, contaminations by external gases, such as $H_2$, $O_2$ or $H_2O$, can be reduced to a minimum. The still open tube can be heated within the glove box, so that a reduction of particle density in that region is obtained so that, after pinching-off in the glove box, and cooling the discharge vessel, some slight under-pressure will occur in the discharge vessel. By dropping the temperature of the discharge vessel under somewhat less than 100° C., it is possible to carry out the second pinch seal outside of the glove box. This can be done by means of a plasma burner, for example.

The method permits substantial reduction in manufacturing time and simplifies the overall manufacturing process. The absence of a separate exhaust tube eliminates difficulties with differential wall thicknesses of the discharge vessels or any other non-homogeneities. Thus, the radiation emission of the lamp is substantially more uniform than that of prior art lamps which utilize an exhaust tip. The lamp can thus be used readily in combination with optical systems, for example in vehicular headlights. Such headlights require highly precise adjustment and placement so that the illuminated area is sharply separated from a dark area in order to prevent glare.

In accordance with a feature of the invention, the discharge vessel, when still open at one end, is flushed with a gas. The glove box may, but does not necessarily contain the same noble gas as the fill gas. In accordance with a feature of the invention, Xenon is used in the fill gas, which, when the lamp is operated with a power supply providing high starting current, results in particularly low start time until the lamp reaches a high percentage of its rated light output. In accordance with a feature of the invention, the discharge vessel in the region of its light-emitting portion is cooled, for example by liquid nitrogen, to at least −112° C. in order to freeze the xenon within the discharge vessel and prevent vaporization of metal halide and mercury therein. This low temperature must be held until the pinch seal is carried out. The pinch seal is done at a pinch temperature of about 2200° C. The high temperature difference, on the length of only about 6 mm, can be obtained by shielding the heating flames while, simultaneously, spraying liquid nitrogen on the discharge vessel.

Xenon in the discharge vessel provides rapid substantial light output immediately following ignition, so that even in advance of vaporization of the metal halides substantial light output or light flux is available. This lamp is particularly suitable for use in automotive vehicle headlights, where precise adjustment and rapid light generation after energization is required.

In accordance with another feature of the invention, and after the second electrode system has been introduced into the tube, the fill gas is introduced therein through the open end, for example through a fill tube passing through a stopper. The tube is then heated in the region of the location of the sealing foil of the second electrode system, and pinch-sealed. The end of the tube can then be cut off. The stopper, coupled to a pumping head, can be placed on the other, open end of the tube after the first pinch seal has been formed and can remain there until after the lamp is finished and the second pinch seal has been made. The pumping head can be coupled to a dosing or measuring valve of flap.

In accordance with a feature of the invention, the electrode system includes, prior to introduction into the tube, an external lead which is deformed in zig-zag shape, with at least three triangular portions, which have a deflection difference from the centering line slightly more than half the inner diameter of the tube. This arrangement provides for self-centering of the electrode tip and the sealing foil and facilitates handling of the electrode systems, since the zig-zag external lead provides for engagement points against the inner wall of the tube and thus allows precise pre-positioning of the electrode.

DRAWINGS

FIG. 1*a* shows the tube of quartz glass, in side view, which forms the starting element for the process;

FIG. 1*b* is a first step forming a constriction;

FIG. 1*c* is the result of the step of FIG. 1*b*, and after expansion of the bulb;

FIG. 2 is a schematic side view of one electrode system;

FIG. 2*a* is a schematic side view illustrating the formation of the first press seal;

FIG. 3 is the discharge vessel with the first press seal in place;

FIGS. 4*a* to 4*d* illustrate further manufacturing steps in which the discharge vessel is retained within a glove box;

DETAILED DESCRIPTION

Figure 1A:
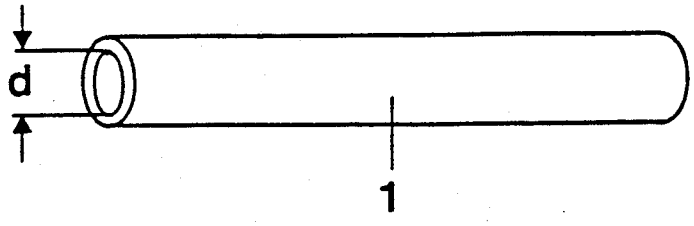
Figure 1B:
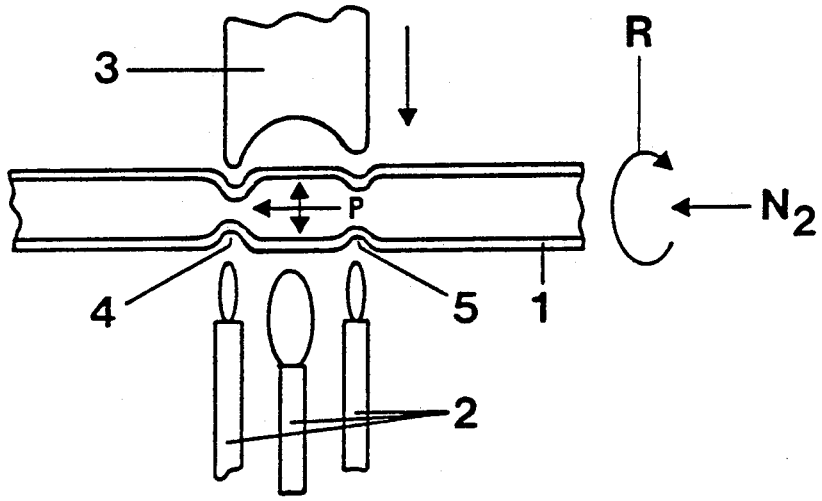
Figure 1C:
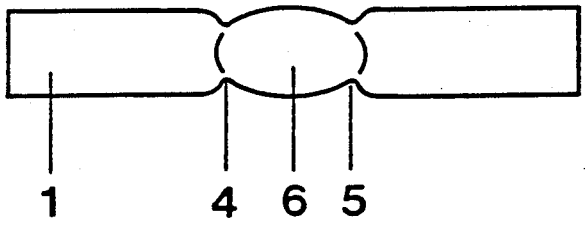

A tube 1 of quartz glass having an outer diameter of about 4.5 mm and an inner diameter d of about 2 mm is cut to a length of about 15 cm. The tube 1 is next held in a rotary holder, not shown, and rotated, as schematically shown, by the arrow R in FIG. 1*b*. Flames 2 are projected against the rotating tube to heat the tube. When the tube has reached deformation temperature, a forming roller 3 is applied thereagainst to form two constrictions 4, 5, at a predetermined spacing from each other. During the heating and deformation, nitrogen is introduced into the inside of the tube at a quantity of about 10 l/h. The constrictions 4 and 5 precisely define the length of the future discharge vessel 6. A suitable length is, for example, about 7.5 mm. The constriction 4 has a smaller internal clearance diameter than the constriction 5. In the heated region of the future discharge vessel 6, thus, gas introduced into the tube 1 will collect and cause a back-pressure P. The back-pressure P of the flow of the nitrogen gas will cause the region between the constrictions to somewhat expand into general bulb or olive shape, so that the center portion which will form the discharge vessel 6 will have an outer diameter of about 5.5 mm, and thus be larger than the outer diameter of the tube 1, and of symmetrical shape, with uniform wall thickness. The roller 3 can be shaped to not only define the constrictions 4, 5, but also the final appearance of the bulb-like discharge vessel 6 (see FIG. 1*b*).

Figure 2:
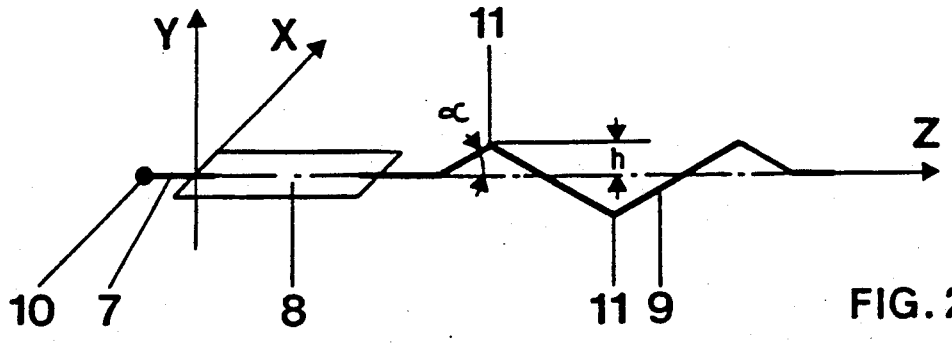

In another operating step, an electrode system is premanufactured. FIG. 2 illustrates the electrode system which will then be introduced into that end of the tube 1 in which the constriction 4, that is, of smaller diameter, has been formed. The electrode system, see FIG. 2, is made of an internal electrode 7 of tungsten, which terminates in a spherical or ball-shaped tip 10. The tungsten electrode is secured, for example by welding, to a sealing foil 8 of molybdenum, to which an external molybdenum lead 9 is connected, for example by welding. The current supply lead 9 is bent in zig-zag shape in the y-z plane. The angle $\alpha$, about which the current supply lead is bent from a straight line, is, preferably, smaller than 45°, and most desirably between about 20° to 30°. The height h, which is the distance from a bend or deflection point 11 to the center line of the electrode, is larger than half the inner diameter d of the tube 1. Experience has shown that a height h of approximately 0.55 d is suitable. The sealing foil 8 is located in the x-z plane, that is, perpendicularly to the y-z plane of the bent-off or bent-over current supply leads 9.

An electrode system of this type is self-holding and self-centering within the tube 1. The bend or deflection points 11 of the current supply lead 9 engage against the inner surface of the tube. Once the current supply lead is introduced and adjusted, the electrode system retains the position until it is finally clamped in the tube, by a pinch or press seal.

At least three bend or deflection points 11 are suitable for the current supply lead 9. Such a current supply lead is self-centering along the axis of the tube 1. This, then, automatically ensures that the electrode 7 within the discharge vessel 6 will be centered along the x-coordinate of the sealing foil 8. Any off-center position perpendicular to the plane of the sealing foil 8, that is, in the y-coordinate, for example due to bend-through of the sealing foil, is automatically compensated when the pinch seal is being made.

The preassembled tube is preferably placed in a holder *7a*, shown only schematically in FIG. *2a*, for introduction of the electrode system thereinto. The tube is heated in the region of the location of the sealing foil to a temperature suitable for deformation and forming of a pinch seal. Such a temperature, typically, is about 2200° C. A stream of argon, as schematically shown in FIG. *2a*, is conducted through the tube. When the pinch sealing temperature is reached, pinch jaws 23 are compressed towards the tube 1 and the first pinch seal 12 is being formed. The first pinch seal is the one which is adjacent the constriction 4, that is, the constriction of the smaller diameter.

Making pinch or press seals is a standard operating procedure in lamp manufacture and any suitable arrangement may be used.

Figure 3:
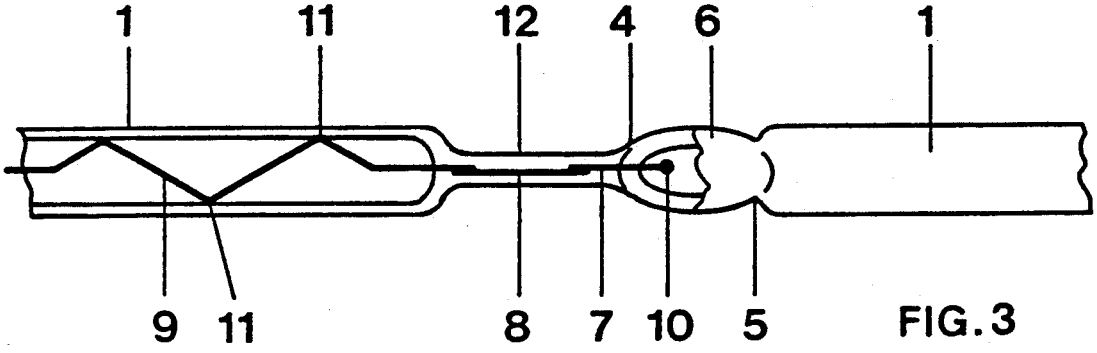

Further production steps are carried out in a glove box 13. Before introducing the tube into the glove box, however, the tube 1, with the first pinch seal 12 applied, as seen in FIG. 3, is cleaned in a high vacuum heater, for annealing or glow heating at a temperature of somewhat over 400° C. and at a vacuum of less than $2\times10^{-5}$ mbar. The glove box is filled with an inert starting gas. A suitable starting gas, for example, is argon. The fill pressure need not differ by more than a few 10 mbar from surrounding atmospheric pressure. The fill gas in the glove box 13 may correspond to the future fill gas of the metal halide high-pressure discharge lamp. The steps which are carried out are illustrated in FIGS. *4a* to *4d*.

In accordance with another feature of the invention, the fill gas is xenon, which results in a lamp of extremely short run-up time, that is, an extremely short duration after ignition of the lamp and until a substantial light output, for example 90° rated light output, is obtained.

FIG. *4a* shows, again, the partly made lamp, with the pinch seal 12 at one side, within a glove box 13. The discharge vessel 6, which in the meanwhile has cooled, receives non-gaseous filler substances, in form of pellets. The fill substance is a metal halide pellet 14 and optionally a drop of mercury 15. A second electrode system, identical to the electrode system described in FIG. 2, is then introduced, within the glove box, into the other and still open end of the tube 1. The fill pellet and mercury drop fall through the still open constriction 5, that is, the constriction with the larger diameter, into the discharge vessel 6. The electrode system, prepared similarly to the electrode system for the first pinch seal 12, is placed into the discharge vessel and accurately located therein. The spacing of the two tips )0, that is, the spherical ends of the electrodes 7, should have a precise value. This spacing then also determines the position of the arc within the high-pressure discharge lamp.

Figure 5:
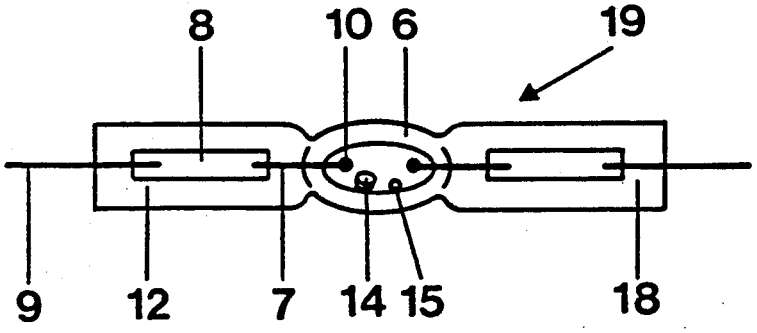
FIG. 5 illustrates the finished discharge lamp.

The still open tube 1 is then heated by a heater (not shown). This results in a reduction of particle density in the region which is heated. The still open tube, and still within the glove box 13, is then melted shut and tipped off, as seen at 17 in FIG. *4d*. This can be done by a laser or a plasma burner, such as the burner 16. After cooling of the lamp so made, a fill pressure of about 300 mbar below surrounding atmospheric pressure will form within the discharge vessel. The finished lamp can then be taken out of the glove box 13. Thereafter, and as described in connection with the first pinch seal 12, the region about the sealing foil 8 of the second electrode system is heated to a pinch sealing temperature of about 2200° C. and a second pinch seal 18, see FIG. 5, is made. During the heating and pinch sealing step, the region of the discharge vessel 6 is cooled to less than 100° C. by cooled nitrogen, in order to prevent vaporization of the metal halide 14 and the mercury 15.

The lamp is then taken out of the pinch seal jaws 23, and the portions of the tube extending beyond the pinch seals 12 and 18 are cut off. The zig-zag portion of the external current supply lead 9 likewise can be removed. The finished lamp 19 is then shown in FIG. 5.

In accordance with a feature of the invention, and if xenon is to be used only in part, and as an alternative to the sequence of steps described, glove box 13 (see FIG. *4a*) is filled with argon. The xenon which is to be used for the final fill of the lamp is later introduced into the glove box. This can be done by blowing xenon through a separate flushing duct introduced into the still open other end of the tube 1, as schematically shown at *6a* in FIG. *4b*. This step can be carried out before or after the introduction of the pellets 14, 15. It is desirable, after introduction of the pellets 14, 15, to flush the electrode system 7 to 10 also with xenon, that is, to introduce the electrode system into the discharge vessel 6 and then carry out another flushing step.

Rather than using a second flushing with xenon, a gas exchange can be carried out after the second electrode system has been introduced into the tube and the discharge vessel 6. Such a second gas exchange can be done by a pumping head 25, coupled to the end *1a* of the tube 1, the pumping head being located within the glove box 13 and, for example, engageable with the end *1a* under external control. Thereafter, the tube 1 can be closed, as above described in connection with FIGS. *4c* and *4d*.

A lamp closed in this manner will retain a mixture of the argon atmosphere within the glove box 13 and the fill gas xenon. The xenon portion within the discharge vessel 6 will be between about 50% to 95%, in dependence on the dwell time of the tube between the gas exchange through the filler tube *6a* and the heating and closing-off at the tip 17. The cold fill pressure of the xenon can be determined by the fill pressure and the composition of the filling gas as a whole. The closed lamp vessel has, usually, a cold fill pressure in the order of 800 mbar.

Rather than using a glove box atmosphere with argon, it is also possible to fill the glove box 13 with nitrogen or helium, xenon then being introduced by one or more flushing ducts *6a* and the pumping head 25, coupled thereto. Such a method has the advantage that the fill of the glove box 13 can use a cheaper gas than the expensive xenon itself. Xenon is then used only to fill the lamp vessel 6.

Figures 4A, 4B:
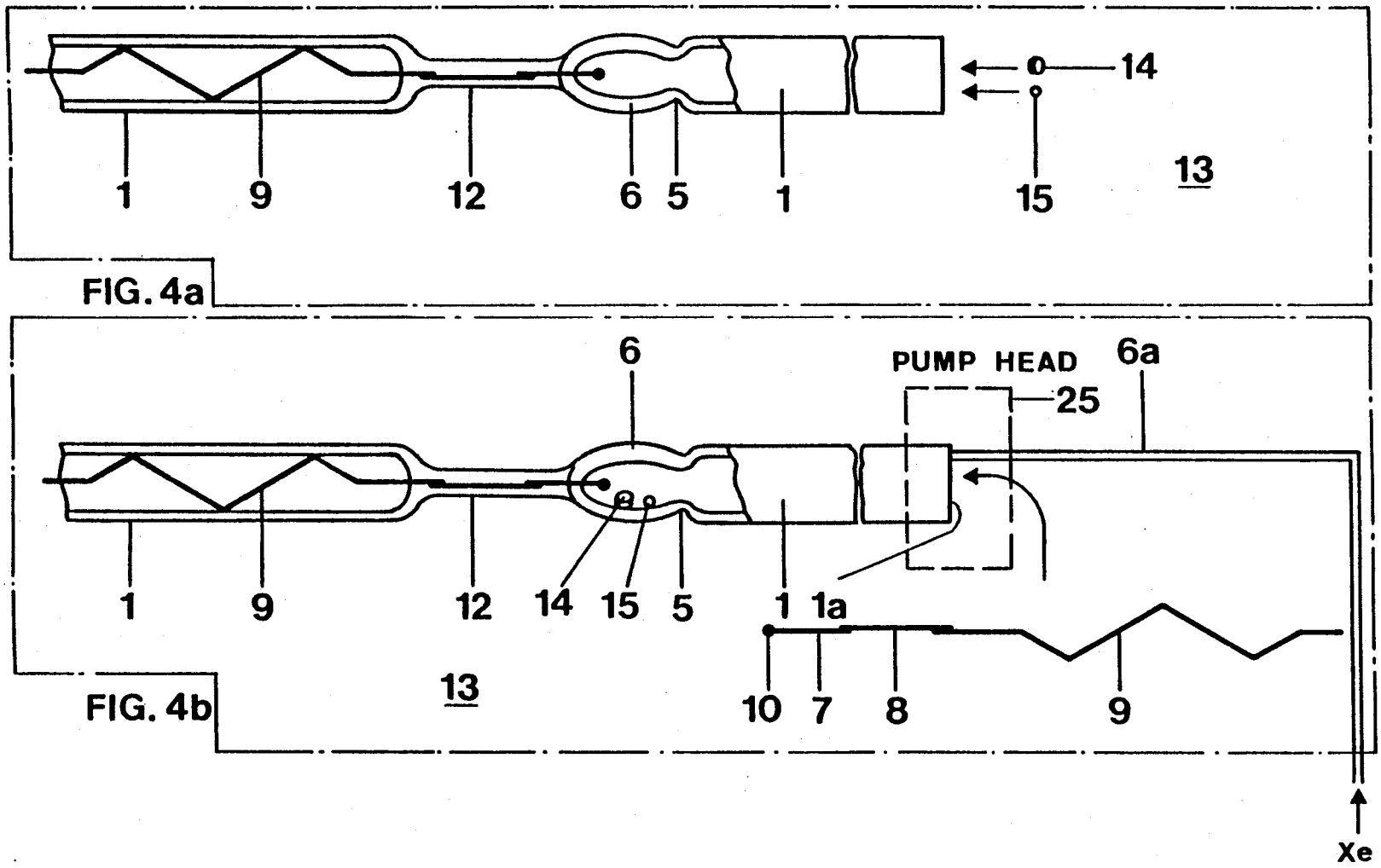
Figure 4C:
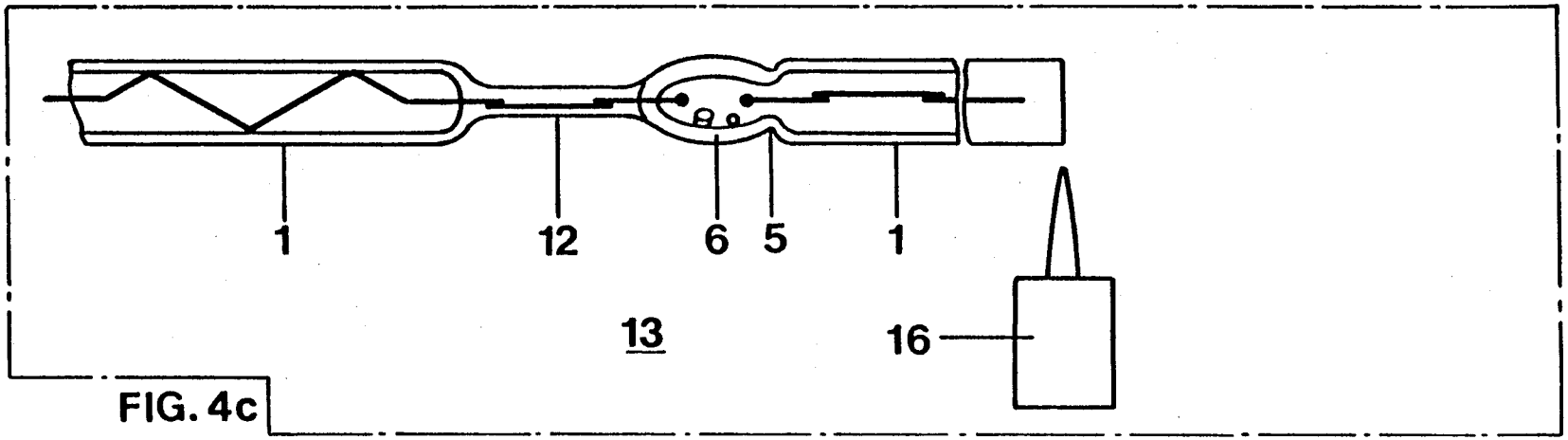
Figure 4D:
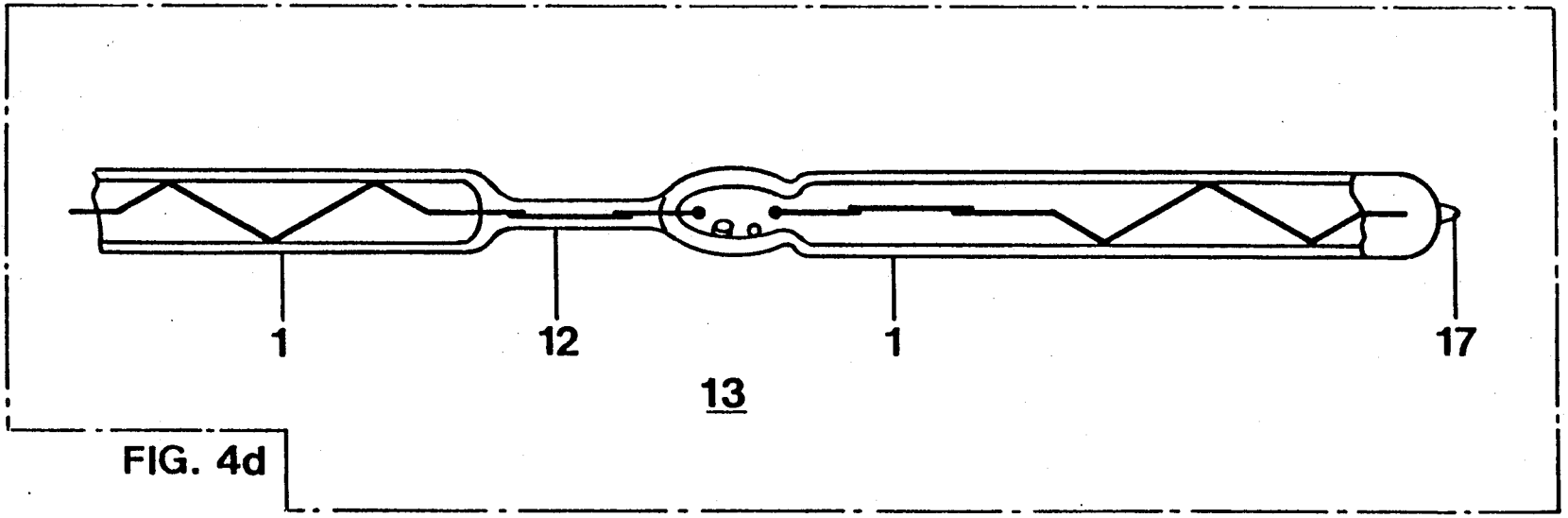

The lamp, then, removed from the glove box 13 is pinch-sealed as above described. The lamp vessel 6 is cooled; when using xenon, it is preferred to cool the lamp vessel 6 by liquid nitrogen to at least −112° C., in order to freeze the xenon within the discharge vessel 6 and prevent vaporization of the metal halide 14 and the mercury 15. This low temperature must be held until the pinch seal is finished. The high temperature difference of about 2400° K. on a length of only 6 mm can be obtained by shielding the heating flames by shielding sheets, for example of sheet metal, and simultaneously spraying liquid nitrogen on the discharge vessel in the lower region thereof. Since the mass of the pinch seal 18 is very low, and thus will heat rapidly, the time to heat the region for making the pinch seal until carrying out the pinch seal itself may take only 5-6 seconds. The pinch seal 18 is then cooled by blowing air thereagainst. The resulting xenon cold fill pressure will be in the region of from 1 to 30 bar. It results upon complete freezing of the xenon from the xenon partial pressure in the tightly closed melted tube 1 (FIG. 4*d*) and the relationship of the volume of tube 1 to the volume of the discharge vessel 6. A typical xenon partial pressure in tube 1 is about 600-800 mbar. With a tube volume of 0.30 $cm^3$ and a discharge vessel volume of 0.025 $cm^3$, a xenon cold fill pressure in the discharge vessel 6 of 7-10 bar will result.

The mercury drop 15 is not strictly necessary when using xenon; the function of the mercury in the discharge vessel can be carried out by the xenon. A metal halide filling, for example NaSc, can control the color of the emitted light contrary to customary xenon high-pressure lamps; the halogen cycle process within the lamp during operation may then provide longer lamp life. Using the xenon fill permits increase of light output by more than 15%.

Figure 6:
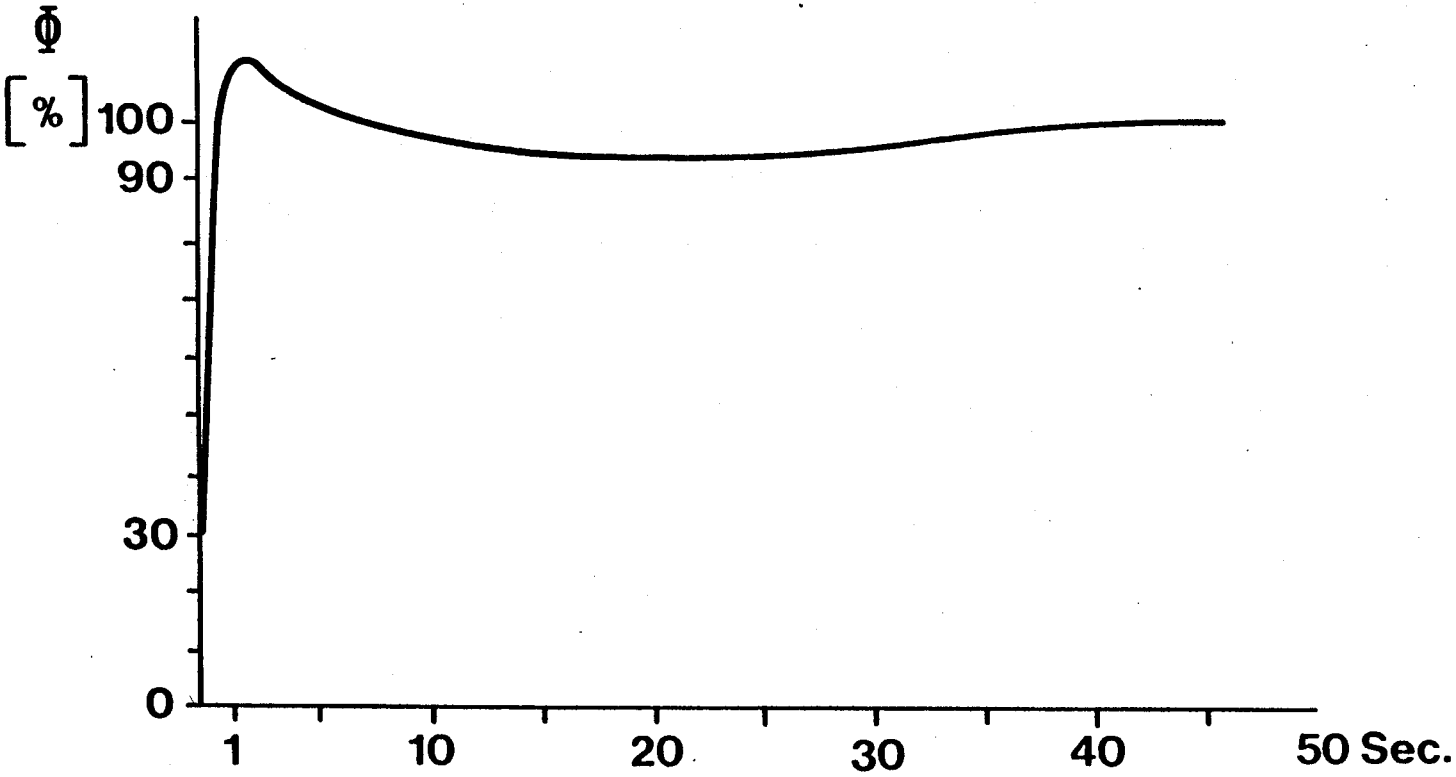
FIG. 6 is a diagram of light flux $\phi$ with respect to time for a lamp which includes a xenon fill.

Light output with respect to time, after energization of the lamp, is shown in FIG. 6. The lamp 19 (FIG. 5) is operated in conjunction with an electronic operating circuit which controls run-up current. The xenon cold fill pressure within the discharge vessel 6 was about 6 bar. The operating current of the lamp is in the order of about 0.35 A at about 100 V; run-up current is about 3.3 A, corresponding to about 8.5 times the nominal rated current of the lamp 19. As can be clearly seen from FIG. 6, 30% of the light flux $\phi$ is obtained effectively immediately and 90% of the light flux already at 1 second.

Figure 2A:
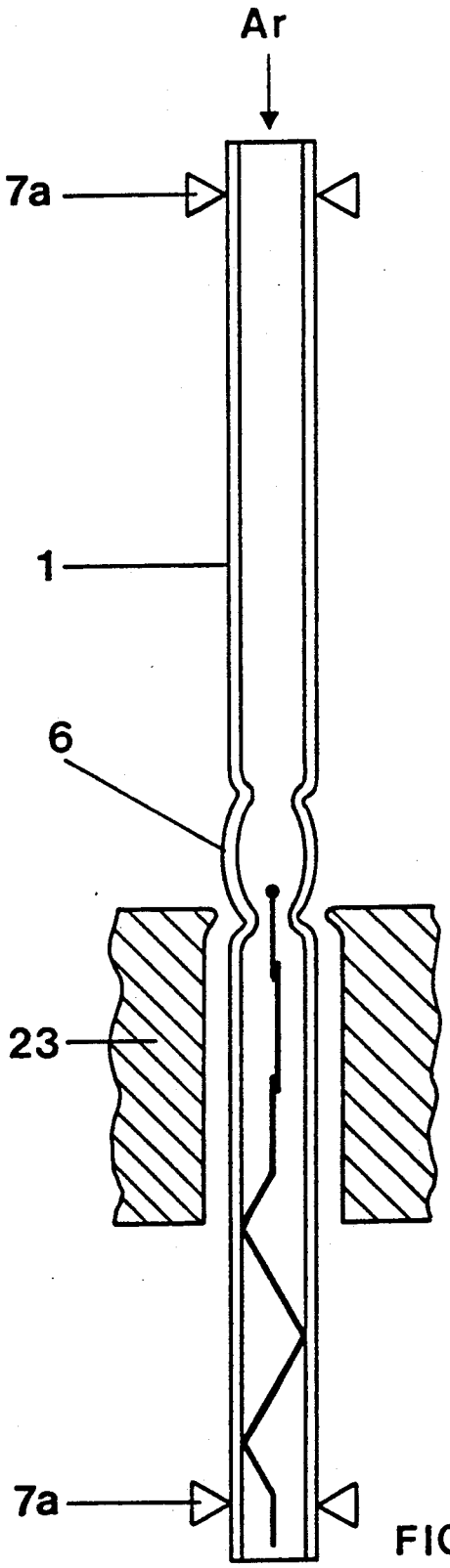
Figure 7:
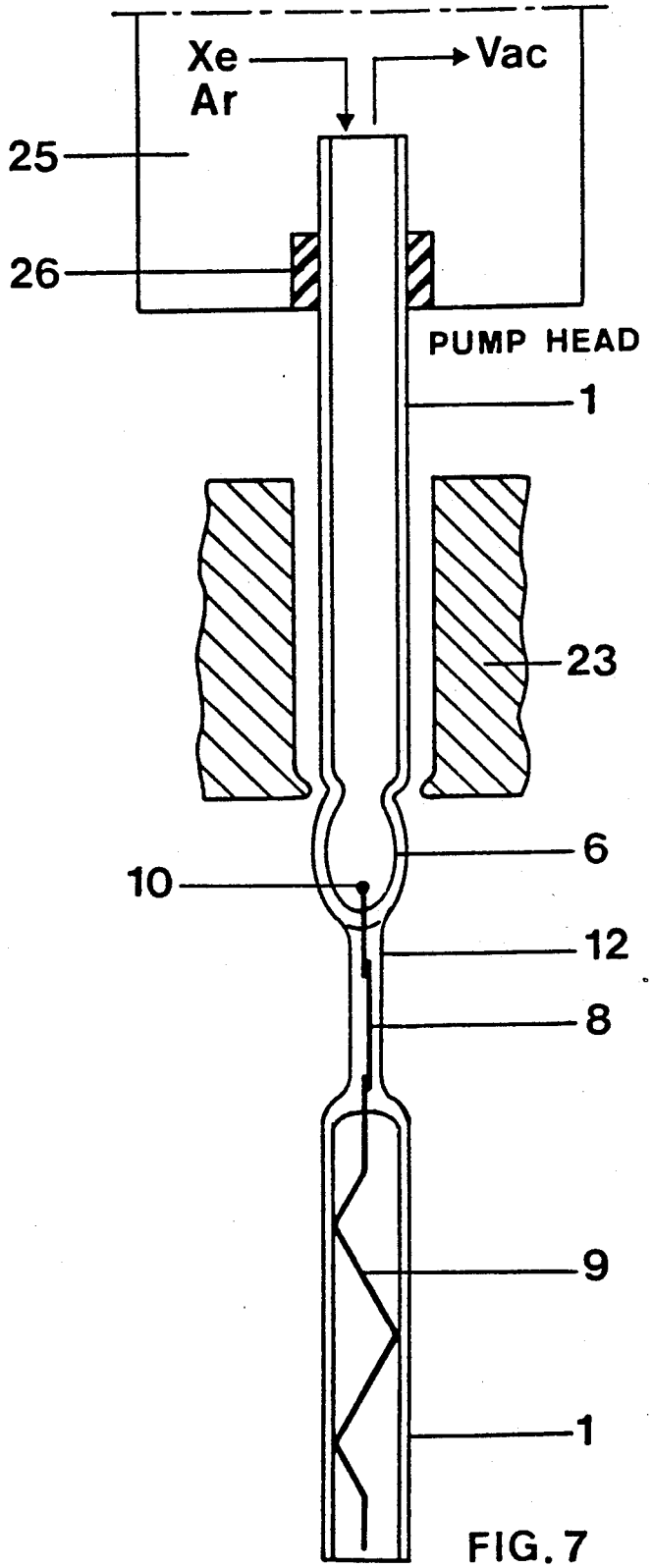
FIG. 7 illustrates manufacturing steps using a pumping head.

In accordance with another embodiment of the invention, the lamp fill is not carried out in a glove box but, rather, by an external gas supply connection. Referring to FIG. 7: The tube 1, with one electrode system introduced and pinch-sealed therein, as shown in FIG. 3, is removed from the holder arrangement 7*a* (shown in FIG. 2*a*) and annealed or glow-treated at about 1200° C. for about 6 hours in a high vacuum glow apparatus. The then glowed lamp, after cooling, will have a pumping head 25 attached thereto by means of a sealing bushing 26, see FIG. 7. The pumping head 25 and the sealing bushing 26 may remain on the tube 1 until the lamp is finished and the second pinch seal 18 is made.

Pinch jaws 23, as used to make the first pinch seal 12, are already in place to form a second pinch seal 18. The pumping head 25 permits flushing, evacuating and pumping of fill gas into the discharge vessel 6. The discharge vessel is cleaned when in this position. The discharge vessel 6 as well as the region of the first pinch seal 12 are heated to at least 400° C. The heated discharge vessel 6 is evacuated and flushed with argon. The flushing and evacuation cycle is repeated four times. The discharge vessel is then permitted to cool and the non-gaseous fill pellets 14, 15 are introduced therein. As noted, it is not strictly necessary to use mercury if, for example, the eventual fill gas will be xenon.

The fill pellet or pellets 14 and 15 fall through the still open constriction 5, that is, the constriction with larger diameter, into the discharge vessel 6. The electrode system, upon being introduced into the tube 1, is self-holding and adjusted to be placed in the discharge vessel at its predetermined position, so that the electrode 7 will be so placed that the tips 10 of the two electrodes are spaced at the precise design values. These steps are carried out through the pumping head 25. Alternatively, the pumping head 25 may have a measuring or dosing flap or opening, not shown, in which an inert counter gas flow is provided, to prevent introduction of contaminants into the discharge vessel 6. After introducing the requisite fill pellets and the second electrode system, the dosing or measuring flap is closed, and the discharge vessel 6 is evacuated by the pumping head 25. The noble gas which is used in the discharge vessel 6 is then introduced. This may, for example, be the final fill of argon, having a cold fill pressure of 500 mbar, and thus somewhat less than the atmospheric pressure surrounding the discharge vessel 6.

Rather than introducing argon, xenon may also be introduced, or a mixture of xenon and another noble gas, as above described.

A second pinch seal 18 is then formed in a manner similar to that previously described in connection with pinch seal 12. The tube is heated in the region of the molybdenum foil 8 to a pinch sealing temperature of about 2200° C. and the lamp is thereby sealed by pinch sealing and locating the second electrode system in its appropriate position in the lamp. While carrying out the second pinch seal, the discharge vessel 6 is cooled, for example by nitrogen cooled to −50° C., so that the discharge vessel will be at a temperature of 100° C. or thereabouts. If xenon is used, the temperature of the discharge vessel should be substantially lower, for example −112° C. or less, as above described. Cooling of the discharge vessel 6 prevents vaporization of the metal halide 14 and, if present, of the mercury 15 and also provides for freezing of the xenon in the discharge vessel 6.

The connection of the lamp to the pumping head 25 is then severed and the portions of the lamp 1 extending beyond the pinch seal are removed, as above described.

Various changes and modifications may be made and any features described herein in connection with any one of the embodiments may be used with any of the others, within the scope of the inventive concept.

We claim:

1. Method of manufacturing a double-ended high-pressure discharge lamp, wherein the finished lamp comprises a bulb-like discharge vessel (6);

two pinch or press seals (12, 18) located on opposite sides of the discharge vessel;

two electrode systems (7-10), one each passing gas tightly through a respective pinch or press seal (12, 18), each electrode system having a sealing foil (8) within the pinch or press seal, an externally projecting current supply lead (9), an internally projecting electrode shaft (7) and an electrode tip (10) thereon, said method comprising the steps of a) providing a cylindrical hollow tube (1), open at both ends, of quartz glass, a1) heating and circumferentially constricting said cylindrical tube at predetermined spaced locations to form constructions, between which constrictions the bulb-like discharge vessel (6) will be formed and to define two cylindrical tube end portions;

b) providing a first preformed electrode system (7–10);

b1) introducing said first electrode system into a first end portion of the tube (1) and aligning said first electrode system in the tube for placement of the electrode tip in a predetermined position within the discharge vessel;

c) heating the tube in the region of the location of the sealing foil (8) of the first electrode system;

c1) pinch-sealing said tube (1) at said first end portion to seal the sealing foil of the first electrode system, and adjacent portions thereof and to form a first pinch seal (12) and thereby closing one end of said tube;

d) introducing at least one fill substance (14, 15) in non-gaseous form into the tube and into said discharge vessel from the other still open end of the tube;

e) providing a second preformed electrode system (7–10);

e1) introducing said second electrode system through the still open second end portion of the tube (1) and aligning said electrode system in said tube for placement of said second electrode system in a predetermined position within the tube and with respect to said first pinch-sealed electrode system;

said method including the further steps of:

f) introducing a noble fill gas through the other still open end of the tube (1); and g) finishing the lamp by heating the second end portion of the tube (1) in the region of the location of the sealing foil (8) of the second electrode system, and g1) pinch-sealing said tube to seal the sealing foil of said second electrode system and adjacent portions thereof and form a second pinch seal (18) and close the other end of the tube;

wherein the steps d), e1) and f) are carried out in a glove box (13); and further including the step of closing off gas-tightly the still open end of the tube (1) while still within the glove box (13) by a heater (16).

2. The method of claim 1, wherein the step f) of introducing the fill gas is carried out essentially at the same time as step d) of introducing the at least one non-gaseous fill substance (14, 15).

3. The method of claim 1, further including the step of conducting an inert gas through the open tube (1) during the steps a1) and c).

4. The method of claim 1, including the step of maintaining the discharge vessel (6) at a temperature of non higher than 1000° C. while carrying out step c).

5. The method of claim 1, further including the step of heating and subjecting the discharge vessel to high vacuum subsequent to the step c1).

6. The method of claim 1, further including the step of heating the second, still open end of the tube (1) within the glove box (13) subsequent to step f).

7. The method of claim 1, wherein the externally projecting current supply lead (9) of at least one of said electrode systems (7–10) is shaped to form a self-holding, self-centering form when introduced into said tube (1).

8. The method of claim 7, wherein said externally projecting current supply lead is deformed in undulating or zig-zag shape having at least three kink or deflection points (11) engageable with the inner wall of said tube (1) for supporting said electrode system in self-holding, essentially self-centering position within said tube.

9. The method of claim 1, including the step of maintaining the discharge vessel at a temperature of below 100° C. while carrying out step g).

10. The method of claim 9, wherein the step of maintaining the discharge vessel at below 100° C. comprises the step of cooling the discharge vessel with a chilled gas.

11. The method of claim 10, wherein said chilled gas comprises cooled nitrogen or argon or air.

12. Method of manufacturing a double-ended high-pressure discharge lamp, wherein the finished lamp comprises a bulb-like discharge vessel (6);

two pinch or press seals (12, 18) located on opposite sides of the discharge vessel;

two electrode systems (7–10), one each passing gas tightly through a respective pinch or press seal (12, 18), each electrode system having a sealing foil (8) within the pinch or press seal, an externally projecting current supply lead (9), an internally projecting electrode shaft (7) and an electrode tip (10) thereon, said method comprising the steps of a) providing a cylindrical hollow tube (1), open at both ends, of quartz glass, a1) heating and, by an external tool means circumferentially constricting said cylindrical tube at predetermined spaced locations to form constructions, between which constrictions the bulb-like discharge vessel (6) will be formed and to define two cylindrical tube end portions;

b) providing a first preformed electrode system (7–10);

b1) introducing said first electrode system into a first end portion of the tube (1) and aligning said first electrode system in the tube for placement of the electrode tip in a predetermined position within the discharge vessel;

c) heating the tube in the region of the location of the sealing foil (8) of the first electrode system;

c1) pinch-sealing said tube (1) at said first end portion to seal the sealing foil of the first electrode system, and adjacent portions thereof and to form a first pinch seal (12) and thereby closing one end of said tube;

d) introducing at least one fill substance (14, 15) in non-gaseous form into the tube and into said discharge vessel from the other still open end of the tube;

e) providing a second preformed electrode system (7–10);

e1) introducing said second electrode system through the still open second end portion of the tube (1) and aligning said electrode system in said tube for placement of said second electrode system in a predetermined position within the tube and with respect to said first pinch-sealed electrode system;

said method including the further steps of:

f) introducing a noble fill gas through the other still open end of the tube (1); and g) finishing the lamp by heating the second end portion of the tube (1) in the region of the location of the sealing foil (8) of the second electrode system, and g1) pinch-sealing said tube to seal the sealing foil of said second electrode system and adjacent portions thereof and form a second pinch seal (18) and close the other end of the tube; and wherein said step a1) includes heating said tube to deformation temperature between said constrictions; and introducing an inert gas from one end into said tube while throttling escape of the gas from the other end to thereby cause the portion of the deformable tube between said constrictions to bulge and form said bulb-like discharge vessel (6).

13. The method of claim 1, including the step of cleaning the discharge vessel between steps c1) and d) by at least one gas flush-evacuation pumping cycle.

14. The method of claim 1, wherein the steps d) to f) are carried out within a hermetically closed system (13);

and wherein said hermetically closed system includes the gas which forms the fill gas for said discharge vessel.

15. The method of claim 1, wherein the fill gas includes xenon.

16. The method of claim 1, wherein the steps d) to f) are carried out within a hermetically closed system (13);

and wherein said hermetically closed system has an inert gas therein which differs from the fill gas to be introduced into said discharge vessel.

17. The method of claim 16, including the step of introducing the fill gas into the discharge vessel before carrying out the steps d) to g).

18. The method of claim 15, including the step of cooling the discharge vessel (6) during the step g) to at least −112° C.

19. The method of claim 18, wherein said cooling step comprises exposing the discharge vessel to liquid nitrogen while shielding the discharge vessel from a heat source which heats the tube (1) to provide for pinch-sealing of the tube in accordance with step (g1).

20. The method of claim 1, including the step of heating and melting closed the other still open end of the discharge tube after carrying out step f) and before carrying out step g).

21. The method of claim 1, wherein the heater (16) to close off gas-tightly the still open end of the tube (1) includes at least one of: a plasma burner; a laser.

22. The method of claim 12, wherein the steps d) to f) are carried out within a hermetically closed system (13);

and wherein said hermetically closed system includes the gas which forms the fill gas for said discharge vessel.

23. The method of claim 1, wherein, in advance of or as part of step c1), the discharge vessel (6) and the tube, in the region of the sealing foil (8), are heated to at least 400° C., evacuated, and flushed with a noble gas.

24. The method of claim 23, wherein the sequence of evacuating and flushing comprises evacuation-flush cycles;

and wherein at least three evacuation-flush cycles are carried out.

25. The method of claim 1, including the step of evacuating the discharge vessel (6) in advance of carrying out step f).

26. The method of claim 1, further including the step of severing at least one of: portions of the tube extending outside of and beyond the pinch seals (12, 18); at least part of the externally projecting current supply leads (9) extending beyond the pinch seal.

27. Method of manufacturing a double-ended high-pressure discharge lamp, wherein the finished lamp comprises a bulb-like discharge vessel (6);

two pinch or press seals (12, 18) located on opposite sides of the discharge vessel;

two electrode systems (7–10), one each passing gas tightly through a respective pinch or press seal (12, 18), each electrode system having a sealing foil (8) within the pinch or press seal, an externally projecting current supply lead (9), an internally projecting electrode shaft (7) and an electrode tip (10) thereon, said method comprising the steps of a) providing a cylindrical hollow tube (1), open at both ends, of quartz glass, a1) heating and circumferentially constricting said cylindrical tube at predetermined spaced locations to form constructions, between which constrictions the bulb-like discharge vessel (6) will be formed and to define two cylindrical tube end portions;

b) providing a first preformed electrode system (7–10);

b1) introducing said first electrode system into a first end portion of the tube (1) and aligning said first electrode system in the tube for placement of the electrode tip in a predetermined position within the discharge vessel;

c) heating the tube in the region of the location of the sealing foil (8) of the first electrode system;

c1) pinch-sealing said tube (1) at said first end portion to seal the sealing foil of the first electrode system, and adjacent portions thereof and to form a first pinch seal (12) and thereby closing one end of said tube;

d) introducing at least one fill substance (14, 15) in non-gaseous form into the tube and into said discharge vessel from the other still open end of the tube;

e) providing a second preformed electrode system (7–10);

e1) introducing said second electrode system through the still open second end portion of the tube (1) and aligning said electrode system in said tube for placement of said second electrode system in a predetermined position within the tube and with respect to said first pinch-sealed electrode system;

said method including the further steps of:

f) introducing a noble fill gas through the other still open end of the tube (1); and g) finishing the lamp by heating the second end portion of the tube (1) in the region of the location of the sealing foil (8) of the second electrode system, and g1) pinch-sealing said tube to seal the sealing foil of said second electrode system and adjacent portions thereof and form a second pinch seal (18) and close the other end of the tube; and wherein said step a1) comprises rolling-in the heated tube to form said constrictions (4, 5) and wherein one (4) of said constrictions results in a narrower clear space through tue tube than the other (5) of said constrictions.

28. The method of claim 27, including the step of introducing, while the cylindrical hollow tube is still heated, an inert gas from the side of the wider constriction (5) towards the side of the narrower (4) constriction to form an accumulation of said inert gas within the heated tube and cause bulging of the heated tube to said bulb-like or generally olive-like shape of the discharge vessel (6).

29. The method of claim 28, wherein the inert gas comprises argon or nitrogen.

30. The method of claim 27, wherein the steps d), e1) and f) are carried out in a glove box (13).

31. The method of claim 30, further including the step of closing off gas-tightly the still open end of the tube (1) while still within the glove box (13) by a heater (16) including at least one of: a plasma burner; a laser.

32. The method of claim 35, further including the step of placing the other still open end of the tube (1) in a pumping head (25) and then carrying out the steps d) to g1) while retaining said tube in said pumping head.

33. The method of claim 12, including the step of carrying out the steps d) and e1) under inert gas counterflow conditions.

34. The method of claim 33, wherein said pumping head (15) includes an opening flap to carry out steps d and e1).

35. The method of claim 12, wherein said step of constricting said cylindrical tube further includes forming one (4) of said constrictions to result in a narrower clear space through the tube than the other (5) of said constrictions; and controlling the introduction of said inert gas through said one end of said tube having the wider one (5) of said constrictions to thereby control the shape of the tube region between said constrictions to define the appearance of the bulb-like discharge vessel (6).

* * * * *